United States Patent [19]

Hughes

[11] Patent Number: 4,683,739

[45] Date of Patent: Aug. 4, 1987

[54] KEY OPERATED LOCK

[76] Inventor: Donald R. Hughes, 2600 Brower, Simi Valley, Calif. 93065

[21] Appl. No.: 887,525

[22] Filed: Jul. 21, 1986

[51] Int. Cl.[4] ..... E05B 27/08

[52] U.S. Cl. ..... 70/363; 70/378; 70/419

[58] Field of Search ..... 70/363, 373, 375, 376, 70/378, 416, 417, 419

[56] References Cited

U.S. PATENT DOCUMENTS

| | | | |
|---|---|---|---|
| 1,860,712 | 5/1932 | Gutman | 70/419 |
| 2,222,027 | 11/1940 | Golden | 70/419 |
| 2,629,249 | 2/1953 | Mandelsohn | 70/419 |
| 3,130,573 | 4/1966 | Hines | 70/417 |
| 3,270,538 | 9/1966 | Kerr | 70/363 |

FOREIGN PATENT DOCUMENTS

| | | | |
|---|---|---|---|
| 0139796 | 5/1985 | European Pat. Off. | 70/363 |

*Primary Examiner*—Robert L. Wolfe
*Attorney, Agent, or Firm*—Jack C. Munro

[57] ABSTRACT

An axial type, tubular key operated, cylinder lock which utilizes a plurality of variable strength and variable tension spring-biased pin arrangements which are to be movable when connected with the proper key to a shear-line position achieving operation of said lock. A pin assembly is normally movable longitudinally to its shear-line position. Any attempt to move the pin assembly other than with a properly coded key will result in the pin assembly being deflected to a displaced position deterring against operation of the lock.

12 Claims, 6 Drawing Figures

KEY OPERATED LOCK

BACKGROUND OF THE INVENTION

The field of this invention relates to locks and more particularly to an axial cylinder lock which has been specifically constructed to be "highly pick resistant".

Key operated locks are in widespread use throughout all segments of society. One common form of a key operated lock is what is referred to as a tubular lock. A tubular lock is to connect with a tubular key and, if the proper key is selected, the lock is capable of being opened and closed.

Each tubular lock within the prior art includes a housing within which is located a shaft which is pivoted or rotated when the proper key is inserted within the lock to operate such. Such locks include a plurality of spring-biased pin arrangements each of which are moved a prescribed amount by the key to locate the lock in a shear-line position permitting the lock to be operated. The key connects with a circular, thin opening formed within the face plate. A nosepiece connects witht eh face plate and defines the inner surface of the thin circular opening.

In the past, the nosepiece was fixed to the shaft. Anyone that desired to "pick" such a lock could insert a device that would attach onto the nosepiece and, by exerting a slight rotational torque on the nosepiece, would apply a small amount of torque to each pin arrangement. By carefully moving each of the pins in this torqued position, when a particular pin arrangement became located at the shear-line, this position could be felt by a person knowledgeable in the "art" of picking locks. Once the individual has moved each pin arrangement to its particular shear-line position, the operation of the lock is then obtained without the using of the proper key. This type of procedure is known in the field as "picking".

In the past, there have been many attempts at trying to construct an "unpickable" lock. However, previously, once a manufacturer believed that they constructed such a lock, it is only a matter of a short period of time that someone figures out a way to "pick" the lock. The picking of locks is a desirable business activity for locksmiths. If a person loses a set of keys and does not have a key to open a particular lock, a locksmith can be called to then "pick" the lock and determine the code so that a new key can be made. This eliminates the destructive removal of the entire lock mechanism and the replacement thereof which inherently is far more costly than the picking of the lock. However, in some environments, a "highly pick resistant" lock would be desired with these installations, taking the chance of losing the key.

SUMMARY OF THE INVENTION

The primary objective of the present invention is to construct a lock which is believed to be very highly "pick resistant" and, therefore, not worth the time and/or effort to pick the lock.

Another objective of the present invention is to utilize primarily the conventional tubular lock mechanism requiring only minor modification of such thereby minimizing manufacturing expense.

Another objective of this invention is to provide a lock which provides for the highest degree of security to the user when the user knows that the lock is highly pick resistant. Such a lock would be most desirable on gaming machines, vending machines, laundromats, burglar alarm switches, padlocks, parking meters, Government and military applications, computers and other similar type of equipment.

The lock of the present invention utilizes a housing which is adapted to be fixedly mounted within a door or orhter similar type of structure. Mounted for pivotable or rotational movement within the housing is a shaft and this shaft extends from the housing and is adapted to be connected to a lock lever mechanism which is mounted in conjunction with the door. Movement of the shaft from a locking position to an unlocking position results in similar movement of a locking lever mechanism from a locked position to an unlocked position. In between the shaft and the housing within the interior of the housing is located a plurality of pin arrangements. Each pin arrangement comprises a driver pin, a coding pin and a spring located in an in-line manner. Springs of different tension and variable strength will normally be utilized in a single lock. Each pin arrangement is to be movable in a first direction which is parallel to the longitudinal center axis of the housing. Movement of these pin arrangements in this first direction is achieved by connection with a key. Each coding pin is mounted within an opening in a cage. The cage includes a plurality of annular gaps resulting in the forming of an annular disc between each directly adjacent pair of gaps. Each coding pin has formed within its annular exterior surface a plurality of spaced-apart annular recesses. Normal connection of the pin arrangement with the key results in the pin arrangement being moved only in the first direction. Any attempt to "pick" the lock and the applying of a torque to these pins will result in each of the pins deflecting radially outward so that a disc will connect with an annular recess of each coding pin. Further movement of the coding pin in the first direction is now prevented and any attempt to further "pick" the lock will be to no avail. The variable spring strengths and tensions will also tend to foil the picking process.

DETAILED DESCRIPTION OF THE SHOWN EMBODIMENT

Figure 1:
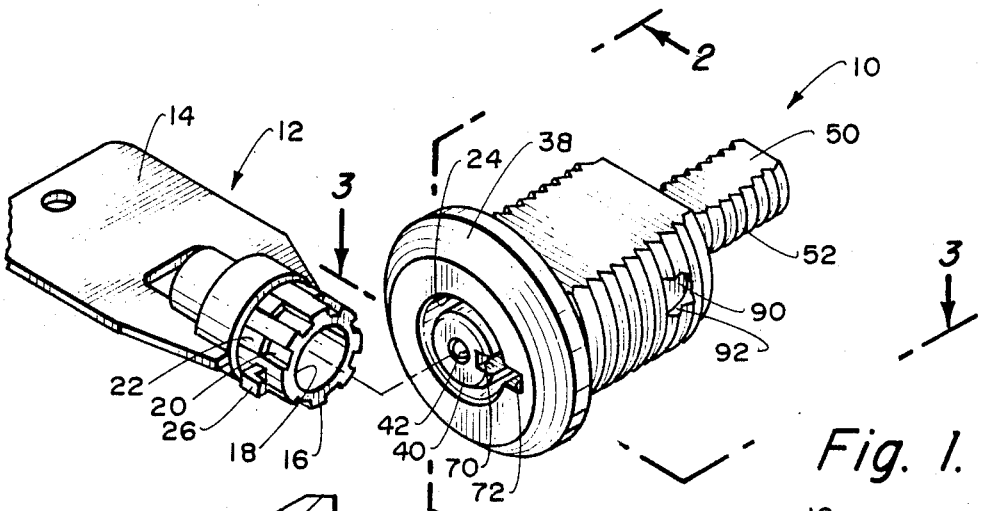
FIG. 1 is an isometric view of the lock of the present invention depicting association with a type of key being used to operate the lock.

Referring particularly to the drawings there is shown the lock 10 of this invention which is to be operated by a key 12. Key 12 includes a handle 14 and a tubular barrel 16. The barrel 16 has a hollow chamber 18. Formed on the exterior surface of the barrel 16 are a plurality of spaced-apart grooves 20. Associated with each groove 20 is a strip 22. The strips 22 are a different length so that the portion of each groove that extends forwardly of the strip is also of a different length. When the barrel 16 is inserted within the opening 24 of the lock 10, there will be a pin (to be described) which will connect with each groove 20. The head of the pin will come into contact with the edge of the strip 22 within each of the grooves 20. The distance of the outer edge of the barrel 16 to the edge of each strip 22 determines the amount of inward movement of each of the pins. If the correct key 12 is connected with lock 10, each of the pins will be moved to locate the lock 10 at a "shear-line" which will then permit the lock 10 to be moved between a locked position and an unlocked position. It is also to be noted that on the exterior surface of the barrel 16 there is located a protuberance 26.

The lock 10 is formed of housing 28 which has an internal chamber 30. Internal chamber 30 is basically cylindrical and is open at the back end and is substantially closed at the front end by an outer annular ledge 32. Ledge 32 terminates at an annular wall 34. The annular wall 34 is formed onto the wall of the internal chamber 30. Also, integrally formed and extending from the wall of the internal chamber 30 is an annular ridge 36. The function of this annular ridge will be explained further on in this specification.

The outer frontal surface of the housing 28 is formed into a planar face 38. The opening 24 extends between the base 38 and the outer annular ledge 32 thereby connecting with the internal chamber 30. Mounted within the opening 24 is a nosepiece 40. The outer planar surface of the nosepiece 40 coincides with the planar face 38 of the housing 28. Mounted within the nosepiece 40 is a metallic ball 42. If someone was to attempt to break the lock 10 by means of drilling into the nosepiece 40; such will be difficult to do because the ball 42 makes it difficult to get the drill started. Also, the ball 42 will be constructed of a hard metallic material, such as generally what ball bearings are constructed from.

The nosepiece 40 includes an inner section 44. This inner section 44 is basically cylindrical in construction with the exception that a portion of the inner section 44 is cut down into a square configuration forming a plurality of planar sides 46. This inner section 44 is located within cylindrical recess 48 of a shaft 50. The shaft 50 has an outer end which extends rearwardly and exteriorly of the housing 28. The exterior surface of this outer end if formed into a series of screw threads 52. The threads 52 are to connect with an appropriate threaded opening (not shown) with a locking lever mechanism (also not shown). A typical locking lever mechanism would be one which would be used in conjunction with an openable door.

The inner end of the shaft 50 is formed into an enlarged section which will be referred to generally as a "cage". This cage is formed by three in number, but not limited to, of annular recesses 54 which are formed within the exterior surface of the cage forming in essence three in number of annular gaps. The portion of the cage that remains between the annular gaps 54 defines discs 56. The outermost disc 56 connects with shear-line 58. The shear-line 58 will be explained further on in this specification.

The shaft 50 has a longitudinal center axis 60. Formed through each of the discs 56 are a plurality of holes 62. It is to be noted that there are seven in number of holes 62. However, it is to be considered within the scope of this invention that the holes 62 could be increased or decreased in number. The longitudinal axis of each hole 62 is located parallel to the longitudinal axis 60. The holes 62 are located for the most part in an evenly spaced-apart manner with the exception of an enlarged single space. Mounted within this enlarged single space is a radially located hole 64. Within the hole 64 is located a coil spring 66 which connects with a locating pin 68. The coil spring 66 exerts a continuous bias against the locating pin 68 tending to locate such in contact with one of the planar sides 46 of the inner section 44. The reason for this is that the nosepiece 40 is generally free to rotate with respect to the housing 28. Formed within the nosepiece 40 is a longitudinal slot 70. A similar slot 72 is formed within the wall surface of the opening 24 of the housing 28. When connecting the key 12 with the opening 24, the protuberance 26 must connect with the slot 72. Fixedly formed within the wall surface of the hollow chamber 18 is a protuberance (not shown). This protuberance is to engage with the longitudinal slot 70. In other words, the key 12 can only be inserted within the opening 24 when slot 70 is directly aligned with the slot 72. To prevent misalignment, the locating pin 68 exerts a slight pressure against one of the planar sides 46 that, if the slots 70 and 72 are aligned, such will remain aligned.

The reason for the four in number of the planar sides 46 is that in some instances it may be desirable to incorporate a second slot 72 formed within the housing 28 at a position displaced ninety degrees from the first slot 72. Once the key 12 is inserted within the opening 24 and rotated slightly, the protuberance 26 is then moved out of contact with the slot 72 and is located against outer annular ledge 32 preventing disengagement of the key 12 from the lock 10. To provide for removing the key 12 at the ninety degree displaced position, a second slot 72 will be formed in housing 28.

Also, it may be desirable to include a third slot 72 located at the one hundred eighty degree displaced position from the first slot 72 or even possibly a fourth slot 72 located at two hundred seventy degrees displaced position from the first slot 72. It is for this reason that there are four in number of the sides 46 provided so that, if there are utilized four in number of slots 72, that it can be assured that the slot 70 will be positioned, when at rest, to be in alignment with one of the slots 72 because of the biasing action of the spring 66 acting against the locating pin 68 which applies pressure against a side 46. Locating pin 68 is hardened to prevent drilling or other forcible destruction of locating pin 68. Locating pin 68 is also a retainer pin which prevents nosepiece 40 from being disconnected forcibly by pulling it from cylinder recess 48 of shaft 50.

Figure 2:
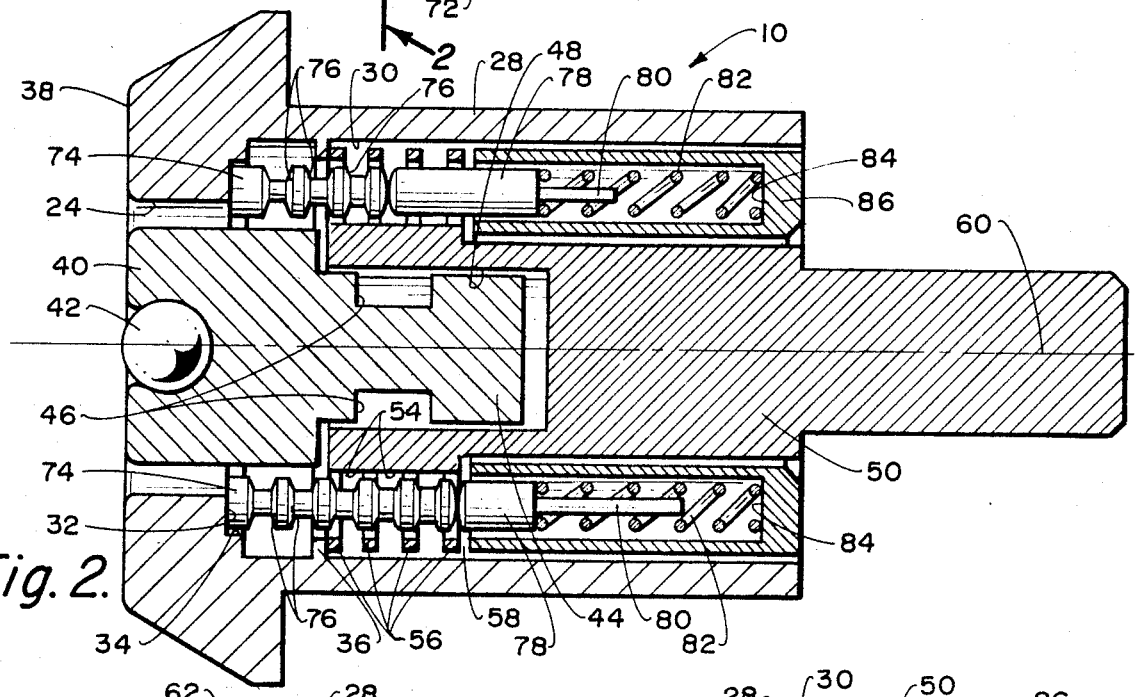
FIG. 2 is a longitudinal cross-sectional view taken through the lock of the present invention taken along line 2—2 of FIG. 1.
Figure 4:
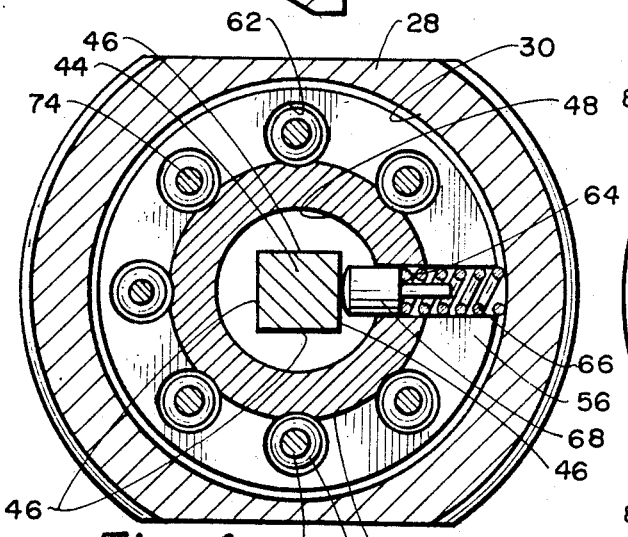
FIG. 4 is a transverse cross-sectional view through the lock of the present invention taken along line 4—4 of FIG. 3.
Figure 5:
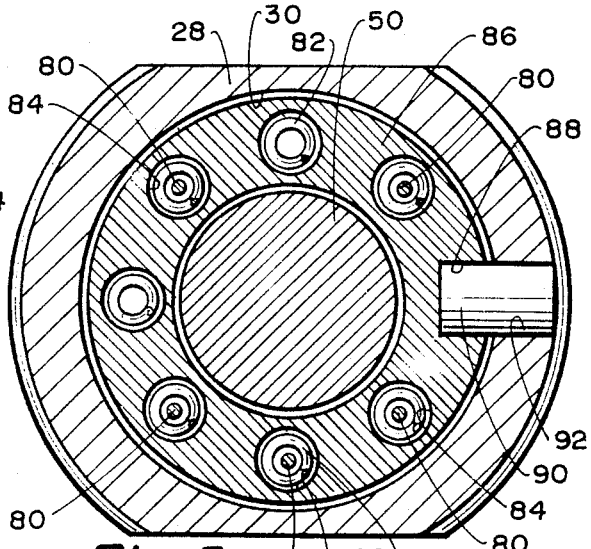
FIG. 5 is a further transverse cross-sectional view through the lock of the present invention taken along line 5—5 of FIG. 3.
Figure 3:
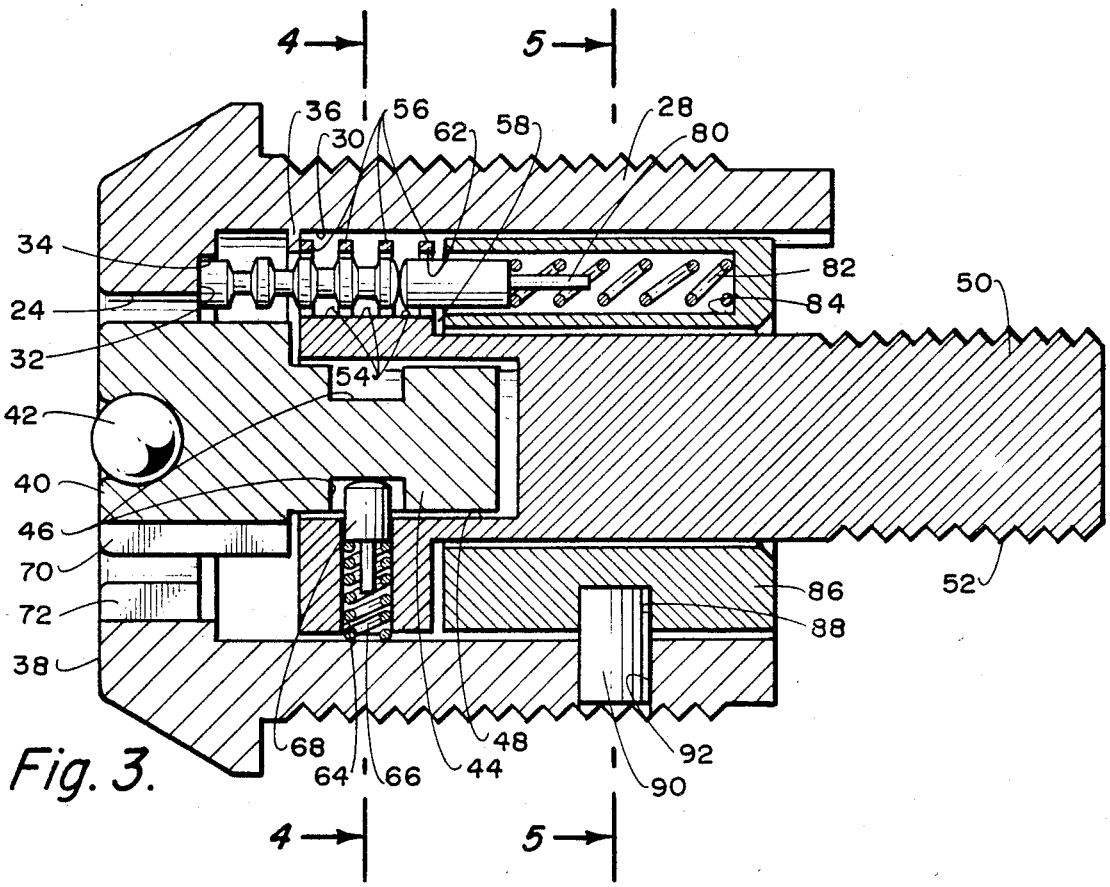
FIG. 3 is a longitudinal cross-sectional view similar to that of FIG. 2 but taken in a direction perpendicular to that of FIG. 2.
Figure 6:
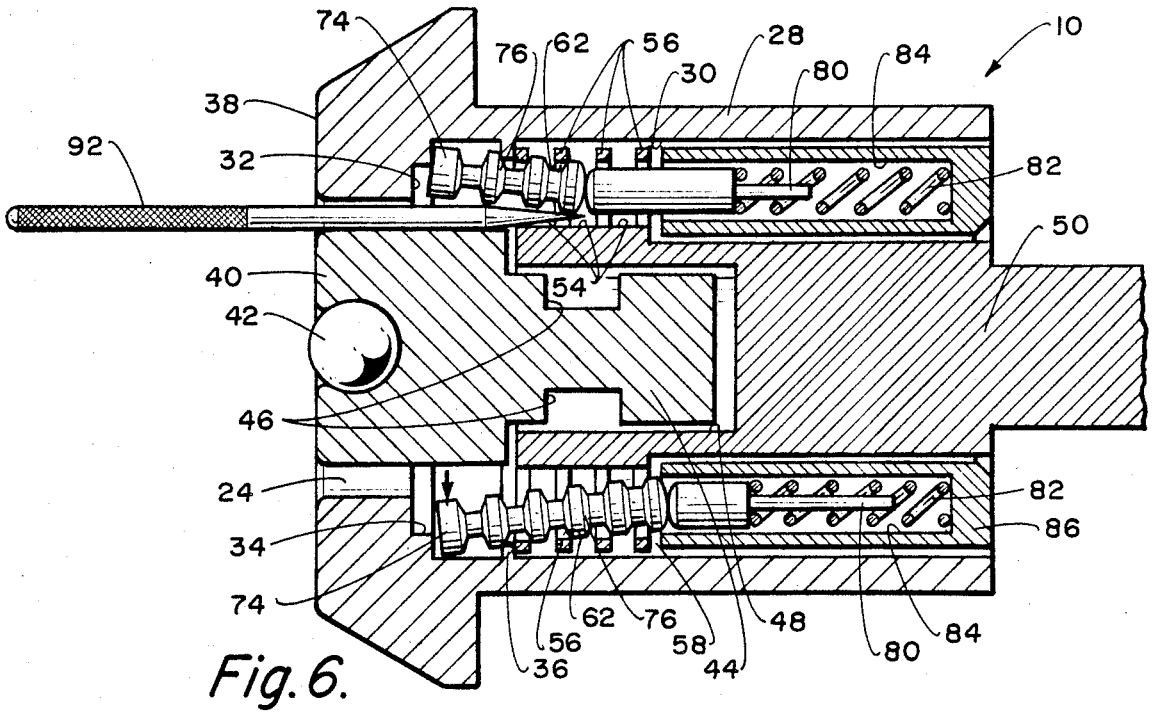
FIG. 6 is a view similar to FIG. 2, but showing the position of the pin arrangements incorporated within the lock of the present invention in the deflected position as such would occur when being contacted by a "lock pick".

Mounted within each hole 62 is a coding pin 74. The coding pins 74 are to be constructed of different lengths which is readily apparent by referring to both FIGS. 2 and 6 of the drawings. The coding pin 74 will be constructed into a series of seven different lengths. The extremes in length of the pins 74 are shown in FIGS. 2 and 6 with the pin 74 located closest to the top of the page being of shortest length with the pin 74 located closest to the bottom of the page being of the longest length. Each coding pin 74 includes a plurality of annular recesses 76. It is noticed that the shortest length pin 74 includes three in number of annular recesses 76 while the longer length pin 74 has five in number of annular recesses 76. There will be three in number of different length pins 74 at the shortest length, with three recesses 76 in each length, three in number of different length pins 74 at the middle length which has four in number of recesses 76, and one pin 74 at the longest length which has five recesses 76.

It is also to be noticed that the annular recesses 76 vary in depth with the recess 76 located nearest the inner end of the pin 74 being shallowest and the recess 76 located closest to the outer end of the pin (nearest outer annular ledge 32) being deepest. The depth of the annular recesses between these two recesses vary proportionately in depth in a stepped arrangement. The reason for this variation in depth of the recesses 76 will be explained further on in this specification.

Each coding pin 74 abuts against a driver pin 78. It is to be noticed that driver pin 78 also vary in length. Mounted on the back end of each driver pin 78 is an extension 80. The function of each extension 80 is to insure that there is connection with a coil spring 82 with there being a separate coil spring 82 for each driver pin 78. Each coil spring 82 of a lock 10 is to vary in strength and tension. Each driver pin 78 and its respective coil spring 82 is mounted within a longitudinal recess 84 of a barrel 86. It is to be understood that there is a separate recess 84 for each driver pin 78. It is further to be understood that the spacing apart of the recesses 84 is identical to the spacing apart of each of the holes 62.

The barrel 86 includes a lateral recess 88. Securing pin 90 is conducted through an appropriate opening 92 formed within the housing 28. The securing pin 90 is then positioned within the lateral recess 88. Therefore, the barrel 86 is now fixed to the housing 28.

In constructing of the lock 10, as the lock 10 is assembled, the longer length coding pin 74 is connected generally to a shorter length driver pin 78. Similarly a shorter length coding pin 74 will be connected to a longer length driver pin 78. When the key 12 is fully inserted within the opening 24, each coding pin 74 will be located within a groove 20. Each strip 22 is to come into contact with its respective coding pin 74 and move such and the driver pins 78 against the action of their respective springs 82. If the length of the strips 22 is properly selected, the point of physical contact between each coding pin 74 and its driver pin 78 will be located to coincide at the shear-line 58. Therefore, upon the applying of a pivoting torque to the key 12, the shaft 50 will pivot relative to the housing 28. Operation of the lock has been obtained.

However, let us suppose that someone decides to attempt to "pick" this lock 10. A form of pick is generally depicted as member 92 shown in FIG. 6. If the pick 92 is applied against a coding pin 74, once that pin 74 is moved away from the annular wall 34, the coding pin 74 is then capable of deflecting laterally toward the wall of the internal chamber 30. This deflection is clearly depicted within FIG. 6. This deflection results in each disc 56 connecting with an annular recess 76 of one or more of the coding pins 74. The portion of the coding pin 74 that is located closest to the outer annular ledge 32 deflects the greatest amount. To accommodate this greatest deflection is why the recesses 76 are deeper adjacent the outer end of each coding pin 74. This greater depth is required in order to permit the coding pin 74 to deflect the necessary amount to be located in contact with, or directly adjacent thereto, the wall of the internal chamber 30.

Once the deflection of the coding pins 74 has occurred, it is just not possible to continue to move the coding pins 74 to "feel" at what point the shear-line 58 is obtained. Therefore, by the usage of any conventional "picking" action, it is exceedingly unlikely, if not impossible, to "pick" the lock 10 of this invention.

Once the pick 92 is removed, each of the coding pins 74 will immediately return to their non-deflected position and remain at rest with the longitudinal center axis of pin 74 parallel to the longitudinal center axis of center shaft 50.

When the lock 10 is in the locked position, a common technique to gain keyless access is to drill through slot 72 to destroy securing pin 90. However, the locating pin 68 is located directly between slot 72 and securing pin 90 which means the drill would have to first destroy locating pin 68. The prevent such, locating pin 68 is constructed of hardened steel.

What is claimed is:

1. A key operated lock comprising:

a housing:

a shaft connected to said housing and extending exteriorly therefrom, said shaft having a longitudinal center axis, said shaft being movable between a locking position and an unlocking position, said shaft being adapted to connect with a separate locking lever mechanism and movement of said shaft causes movement of the separate locking lever mechanism between an unlocked position and a locked position;

means for fixing said shaft to said housing when said shaft is in said locking position, said means comprising a pin assembly, said pin assembly being movable within a range of movement relative to said housing in a direction parallel to said longitudinal center axis, with said pin assembly located in a particular position within said range of movement said shaft is located in said unlocking position;

a portion of said pin assembly being capable of being deflected laterally in a direction substantially transverse to said longitudinal center axis, whereby upon said pin assembly being moved by connection with a key the sad pin assembly moves in a direction only along said longitudinal center axis, whereby any attempt to pick said lock will cause said portion of said pin assembly to be deflected laterally preventing ascertaining of said particular position and movement of said shaft relative to said housing;

said pin assembly comprising a plurality of pin arrangements;

each said pin arrangement comprising an in-line set of a driver pin and a coding pin and a spring, each said driver pin being mounted within a driving pin receiving chamber, each said driving pin receiving chamber being fixed relative to said housing, each said driver pin to be continuously spring-biased by its respective said spring in an outward direction;

said portion of said pin arrangement that is capable of being deflected laterally comprising said coding pins; and each said coding pin including a series of annular recesses, each said coding pin being slideably mounted within an opening formed within a section of said shaft, a plurality of gaps connecting with each said opening with there being formed a disc between each directly adjacent pair of said gaps, said lateral deflection occurs when a said disc slips into a said annular recess.

2. The key operated lock as defined in claim 1 wherein:

said annular recesses of each said coding pin varying in depth.

3. The key operated lock as defined in claim 2 wherein:

said driver pins varying in length within each said lock.

4. The key operated lock as defined in claim 3 wherein:

said springs within a said lock varying in tension and strength.

5. A key operated lock comprising:

a housing:

a shaft connected to said housing and extending exteriorly therefrom, said shaft having a longitudinal center axis, said shaft being movable between a locking position and an unlocking position, said shaft being adapted to connect with a separate locking lever mechanism and movement of said shaft causes movement of the separate locking lever mechanism between an unlocked position and a locked position;

means for fixing said shaft to said housing when said shaft is in said locking position, said means comprising a pin assembly, said pin assembly being movable within a range of movement relative to said housing in a direction parallel to said longitudinal center axis, with said pin assembly located in a particular position within said range of movement said shaft is located in said unlocking position;

a portion of said pin assembly being capable of being deflected laterally in a direction substantially transverse to said longitudinal center axis, whereby upon said pin assembly being moved by connection with a key that said pin assembly moves in a direction only along said longitudinal center axis, whereby any attempt to pick said lock will cause said portion of said pin assembly to be deflected laterally preventing ascertaining of said particular position and movement of said shaft relative to said housing;

said pin assembly comprising a plurality of pin arrangements;

each said pin arrangement comprising an in-line set of a driver pin and a coding pin and a spring, each said driver pin being mounted within a driving pin receiving chamber, each said driving pin receiving chamber being fixed relative to said housing, each said driver pin to be continuously spring-biased by its respective said spring in an outward direction; and said portion of said pin arrangement that is capable of being deflected laterally comprising said coding pin, said coding pins being spaced further from said shaft then said driver pins, said coding pins to be directly contacted by the key.

6. The key operated lock as defined in claim 5 wherein:

means for preventing deflection of said pin assembly when said pin assembly is in said normal at-rest position, said means for preventing deflection comprising an annular shoulder formed within the wall of said internal chamber, said annular shoulder to connect with said coding pins.

7. A key operated lock comprising:

a housing;

a shaft connected to said housing and extending exteriorly therefrom, said shaft having a longitudinal center axis, said shaft being movable between a locking position and an unlocking position, said shaft being adapted to connect with a separate locking lever mechanism and movement of said shaft causes movement of the separate locking lever mechanism between an unlocked position and a locked position;

means for fixing said shaft to said housing when said shaft is in said locking position, said means comprising a pin assembly, said pin assembly being movable within a range of movement relative to said housing in a direction parallel to said longitudinal center axis, with said pin assembly located in a particular position with said range of movement said shaft is located in said unlocking position;

a portion of said pin assembly being capable of being deflected laterally in a direction substantially transverse to said longitudinal center axis, whereby upon said pin assembly being moved by connection with a key the said pin assembly moves in a direction only along said longitudinal center axis, whereby any attempt to pick said lock will cause said portion of said pin assembly to be deflected laterally preventing ascertaining of said particular position and movement of said shaft relative to said housing;

an internal chamber being formed within said housing, said shaft extending within said internal chamber, said pin assembly being located within said internal chamber, said internal chamber having an internal side wall, said pin assembly being spaced from said internal side wall, whereby sufficient distance is permitted to permit deflection of said portion of said pin assembly toward said internal side wall; and a nosepiece located within said internal chamber, said nosepiece being rotatable relative to said shaft, a spring-biased locating pin assembly connected to said shaft, said locating pin assembly to connect with said nosepiece, whereby said locating pin assembly maintaining said nosepiece in an established position relative to said shaft preventing free rotational movement of said nosepiece relative to said shaft, whereby said spring-biased locating pin assembly also preventing forcible removing of said nosepeice from said shaft.

8. The key operated lock as defined in claim 7 wherein:

said shaft being fixed to said housing by a securing pin, with said shaft in said locking position said locating pin assembly being in an axial alignment with said securing pin, thereby resisting destruction of said securing pin by axial drilling requiring first that said locating pin assembly be destroyed.

9. The key operated lock as defined in claim 7 wherein:

said nosepiece further including a metallic ball, said metallic ball deterring physical destruction of said lock.

10. A key operated lock which uses a spring-biased pin assembly which is to be moved in a first direction when connected with the proper key to a shear-line position achieving operation of said lock, said pin assembly being movable in a second direction, said second direction being substantially transverse to said first direction; and said pin assembly comprising a plurality of separate pin arrangements, each said pin arrangement comprising an in-line pair of a driver pin and a coding pin, each said driver pin being spring-biased in its outward direction, each said coding pn to be contactable by said key, movement of said coding pin in said first direction is to achieve movement of its repsective said driver pin, each said coding pin being mounted within a cage, said cage including a plurality of annular gaps thereby forming a disc between each directly adjacent pair of said gaps, each said coding pin comprising a plurality of annular recesses, movement of said coding pins in said second direction results in each said disc being located within a said annular recess, sad discs being spaced apart, said gaps being spaced apart.

11. A key operated lock which uses a spring-biased pin assembly which is to be moved in a first direction when connected with the proper key to a shear-line position achieving operation of said lock, said pin assembly being movable in a second direction, said second direction being substantially transverse to said first direction;

said pin assembly comprising a plurality of separate pin arrangements, each said pin arrangement comprising an in-line pair of a driver pin and a coding pin, each said driver pin being spring-biased in its outward direction, each said coding pin to be contactable by said key, movement of said coding pin in said first direction is to achieve movement of its respective said driver pin, each said coding pin being mounted within a cage, said cage including a plurality of annular gaps thereby forming a disc between each directly adjacent pair of said gaps, each said coding pin comprising a plurality of annular recesses, movement of said coding pins in said second direction results in each said disc being located within a said annular recess; and said annular recesses within each said coding pin being of variable depth.

12. The key operated lock as defined in claim 11 wherein:

each said annular recess of each said coding pin located nearest the point of contact with said key being of the greatest said depth.

* * * * *